US009609943B1

(12) United States Patent
Lin

(10) Patent No.: US 9,609,943 B1
(45) Date of Patent: Apr. 4, 2017

(54) COLLAPSIBLE BISTRO TABLE

(71) Applicant: Zhuhai Shichang Metals Ltd., Zhuhai (CN)

(72) Inventor: Wen-Sheng Lin, Kaohsiung (TW)

(73) Assignee: Zhuhai Shichang Metals Ltd. (CN)

( * ) Notice: Subject to any disclaimer, the term of this patent is extended or adjusted under 35 U.S.C. 154(b) by 0 days.

(21) Appl. No.: 15/002,517

(22) Filed: Jan. 21, 2016

Related U.S. Application Data

(63) Continuation-in-part of application No. 29/550,499, filed on Jan. 5, 2016.

(51) Int. Cl.

| | |
|---|---|
| ***A47B 3/02*** | (2006.01) |
| ***A47B 13/08*** | (2006.01) |
| ***A47C 4/04*** | (2006.01) |
| ***A47C 11/00*** | (2006.01) |
| ***A47C 9/10*** | (2006.01) |
| ***E06C 7/16*** | (2006.01) |
| *A47B 3/08* | (2006.01) |

(52) U.S. Cl.
CPC ..... *A47B 3/02* (2013.01); *A47B 13/08* (2013.01); *A47C 4/04* (2013.01); *A47C 9/10* (2013.01); *A47C 11/00* (2013.01); *E06C 7/16* (2013.01); *A47B 2003/025* (2013.01); *A47B 2003/0821* (2013.01); *A47B 2003/0827* (2013.01)

(58) Field of Classification Search
CPC ..... A47B 3/02; A47B 2003/25
USPC ..... 108/118, 119, 120, 115, 116, 125, 129; 248/423, 157, 164, 439, 168, 188.1, 248/188.2, 188.6; 182/154, 155; 297/4, 297/55, 345, 310, 56
See application file for complete search history.

(56) References Cited

U.S. PATENT DOCUMENTS

| | | | | | |
|---|---|---|---|---|---|
| 606,845 | A | | 7/1898 | Simmons | |
| 906,382 | A | * | 12/1908 | Carrier | A47B 9/16 108/116 |
| 2,053,789 | A | | 9/1936 | Hardy | |
| 2,871,075 | A | * | 1/1959 | Stone | A47B 3/02 108/119 |
| 2,912,775 | A | * | 11/1959 | Gettelman | D06F 81/04 108/117 |
| 3,103,900 | A | * | 9/1963 | Lippman | A47B 3/02 108/10 |
| 4,168,669 | A | | 9/1979 | Arnoff | |

(Continued)

FOREIGN PATENT DOCUMENTS

WO WO03/059119 * 7/2003

*Primary Examiner* — Janet M Wilkens
(74) *Attorney, Agent, or Firm* — Luedeka Neely Group, P.C.

(57) ABSTRACT

A collapsible table includes a tabletop, a first pair of collapsible legs, and a second pair of collapsible legs. The first pair of legs includes a first support bar for connecting a first leg to a second leg adjacent their top end portions, and the first support bar is pivotally connected to the bottom surface of the tabletop. The second pair of legs includes a second support bar for connecting a third leg to a fourth leg and a third support bar spaced apart from the second support bar for connecting the third leg to the fourth leg. One or more brackets are disposed adjacent the bottom surface of the tabletop and are positioned and configured to removably secure the second support bar to the bottom surface of the tabletop in a use position and removably secure the third support bar to the bottom surface in a storage position.

17 Claims, 12 Drawing Sheets

(56) References Cited

U.S. PATENT DOCUMENTS

| | | | | |
|---|---|---|---|---|
| 5,483,901 | A | 1/1996 | Tisbo et al. | |
| 6,213,555 | B1 * | 4/2001 | Sulpizio | A47C 1/143 108/116 |
| 6,912,961 | B2 | 7/2005 | Winter et al. | |
| 7,640,869 | B2 | 1/2010 | Leng | |
| D618,936 | S * | 7/2010 | Xu | D6/691.6 |
| 2006/0191447 | A1 * | 8/2006 | Ashby | A47B 3/02 108/119 |
| 2009/0000528 | A1 * | 1/2009 | Leng | A47B 3/06 108/156 |
| 2010/0186640 | A1 | 7/2010 | Leng | |

* cited by examiner

COLLAPSIBLE BISTRO TABLE

CROSS REFERENCE TO RELATED APPLICATION

This application claims priority as a continuation-in-part of co-pending U.S. Design patent application No. 29/550,499 filed on Jan. 5, 2016, the entire contents of which is incorporated herein by reference.

FIELD

The present disclosure relates to a collapsible table. More particularly, the present disclosure relates to a collapsible bistro table that can be collapsed into a compact position with the legs secured to the bottom surface of the table when not in use, thereby allowing easy storage, package and transportation of the table.

BACKGROUND

A conventional folding or collapsible table is available for providing a support surface in a use position while taking up less space in a storage position. However, particularly in the case of smaller tables in which the supporting legs are generally longer than the width or length of the table surface, the legs are often an inconvenience in storage, package, and transportation because the legs must awkwardly and loosely extend from the table surface in the storage position (e.g., it is difficult to keep the legs in their storage positions). While one solution has been to wrap a rope or cord around one or more table surfaces to secure the legs to the bottom surface of the tables, this requires an undesired extra step, which adds time to packing and storing multiple tables at a time.

What is needed therefore is a table that can be easily moved between a use and storage position where the legs are easily secured to the bottom surface of the table when not in use, thereby allowing easy storage, package and transportation of the table.

SUMMARY

According to one embodiment of the disclosure, a collapsible table includes a tabletop comprising a top surface, a bottom surface opposite the top surface, a first end, and a second end opposite the first end. A first pair of collapsible legs comprising a first leg having a top end portion, a second leg having a top end portion, and a first support bar for connecting the first leg to the second leg adjacent their top end portions is pivotally connected to the bottom surface of the tabletop. The table further includes a second pair of collapsible legs comprising a third leg having a top end portion, a fourth leg having a top end portion, a second support bar for connecting the third leg to the fourth leg adjacent their top end portions, and a third support bar spaced apart from the second support bar for connecting the third leg to the fourth leg. The first and second pair of collapsible legs are operable to move between a use position wherein the legs extend from the bottom surface to support the tabletop to a storage position wherein at least the top end portions of each of the legs are disposed adjacent to the bottom surface of the tabletop. One or more brackets are disposed adjacent the bottom surface of the tabletop, and the brackets are positioned and configured to removably secure the second support bar to the bottom surface of the tabletop in the use position and removably secure the third support bar to the bottom surface of the tabletop in the storage position.

According to certain embodiments, each of the legs of the first and second pair of collapsible legs is operable to collapse to positions which are substantially perpendicular to the first and second ends of the tabletop; each of the legs of the first and second pairs of collapsible legs is of a length that is greater than a distance between the first and second ends of the tabletop; the second end of the tabletop includes a first receiving channel positioned and configured to receive the first leg and the third leg below their top end portions and a second receiving channel positioned and configured to receive the second leg and the fourth leg below their top end portions in the storage position; the tabletop is formed from blow-molded plastic with the one or more brackets integrally formed from the blow-molded plastic of the tabletop; the one or more brackets include a first set of brackets positioned and configured to receive a first portion of the second or third support bar and a second set of brackets positioned and configured to receive a second portion of the second or third support bar for removably securing the second support bar in the use position and the third support bar in the storage position; the one or more brackets are configured to prevent any substantial rotation of the second and third support bars in the respective use and storage positions; the second pair of collapsible legs is pivotally connected to the first pair of collapsible legs; and/or the first support bar is substantially non-removably secured to the bottom surface of the tabletop.

According to another embodiment of the disclosure, a collapsible supporting structure includes a supporting structure comprising a top surface, a bottom surface opposite the top surface, a first end, and a second end opposite the first end. The supporting structure further includes a first pair of collapsible legs and a second pair of collapsible legs. The first pair of collapsible legs include a first leg having a top end portion and a second leg having a top end portion, and each of the top end portions of the first and second legs are secured to the bottom surface of the supporting structure adjacent the first end. The second pair of collapsible legs include a third leg having a top end portion, a fourth leg having a top end portion, a first support bar for connecting the third leg to the fourth leg adjacent their top end portions, and a second support bar spaced apart from the first support bar for connecting the third leg to the fourth leg. The first and second pair of collapsible legs are operable to move between a use position wherein the legs extend from the bottom surface to support the supporting structure to a storage position wherein at least the top end portions of each of the legs are disposed adjacent to the bottom surface of the supporting structure. One or more brackets are disposed adjacent the bottom surface of the supporting structure, the one or more brackets positioned and configured to removably secure the first support bar to the bottom surface of the supporting structure in the use position and removably secure the second support bar to the bottom surface of the supporting structure in the storage position.

According to certain embodiments, each of the legs of the first and second pair of collapsible legs are operable to collapse to positions which are substantially perpendicular to the first and second ends of the supporting structure; each of the legs of the first and second pairs of collapsible legs is of a length that is greater than a distance between the first and second ends of the supporting structure; the second end of the supporting structure includes a first receiving channel positioned and configured to receive the first leg and the third leg below their top end portions and a second receiving channel positioned and configured to receive the second leg and the fourth leg below their top end portions in the storage position; the supporting structure is formed from blow-molded plastic and the one or more brackets are integrally formed from the blow-molded plastic of the supporting structure; the one or more brackets include a first set of brackets positioned and configured to receive a first portion of the first or second support bar and a second set of brackets positioned and configured to receive a second portion of the first or second support bar for removably securing the first support bar in the use position and the second support bar in the storage position; the one or more brackets are configured to prevent any substantial rotation of the first and second support bars in the respective use and storage positions; and/or the supporting structure is one of a table, a chair, a bench, a stool, and a step-ladder.

BRIEF DESCRIPTION OF THE DRAWINGS

Further advantages of the invention are apparent by reference to the detailed description in conjunction with the figures, wherein elements are not to scale so as to more clearly show the details, wherein like reference numbers indicate like elements throughout the several views, and wherein.

DETAILED DESCRIPTION

Figure 1:
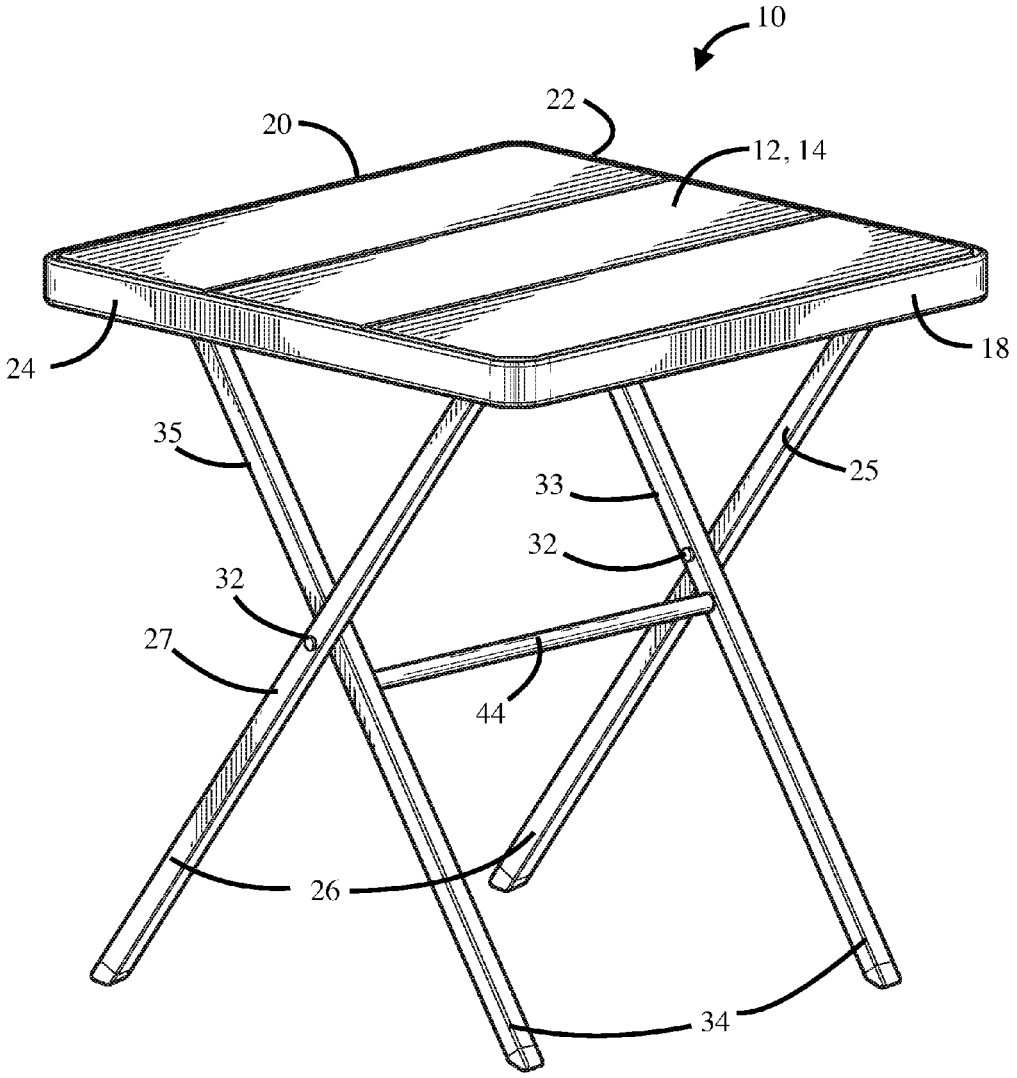
FIG. 1 is a top perspective view of a collapsible table in a use position in accordance with one embodiment of the present disclosure.
Figure 2:
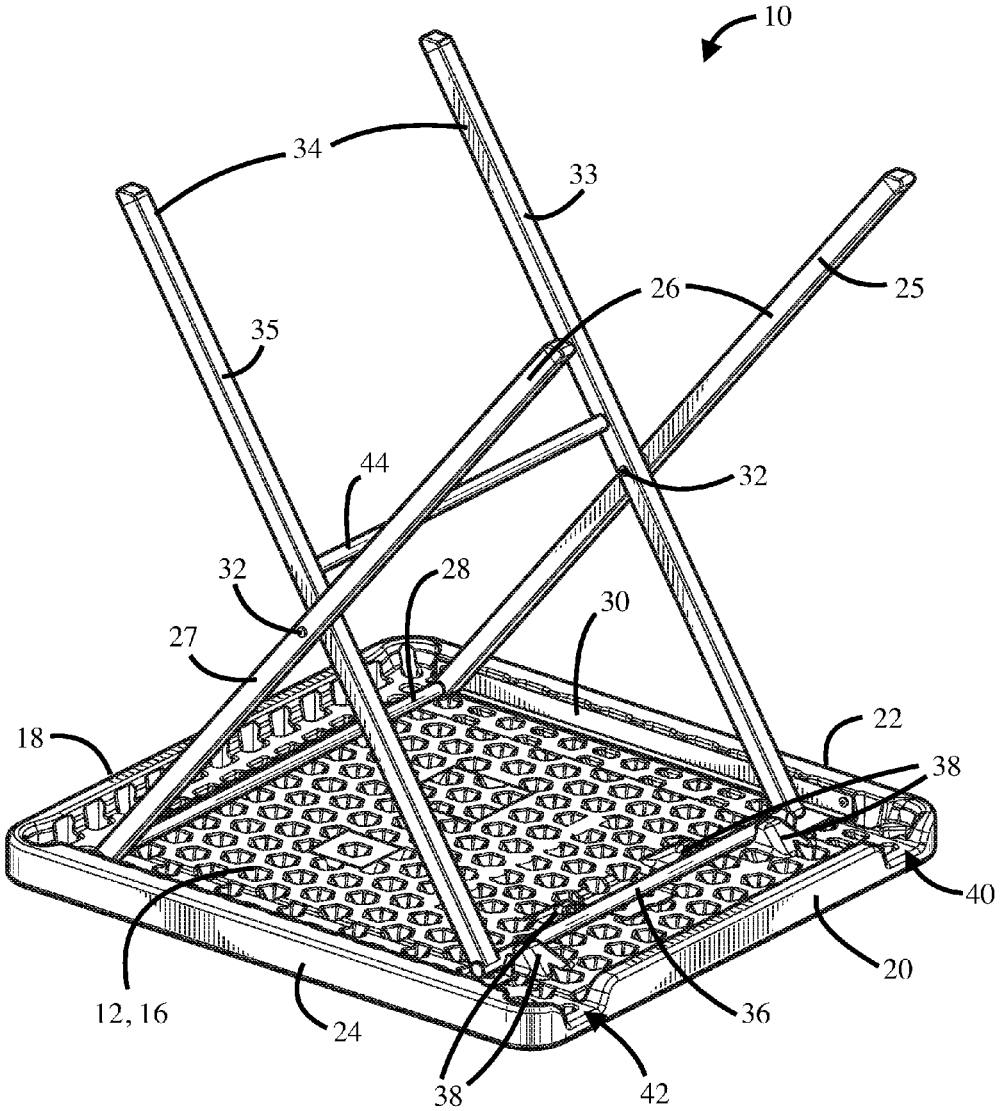
FIG. 2 is a bottom perspective view of the collapsible table in the use position in accordance with one embodiment of the present disclosure.
Figure 3:
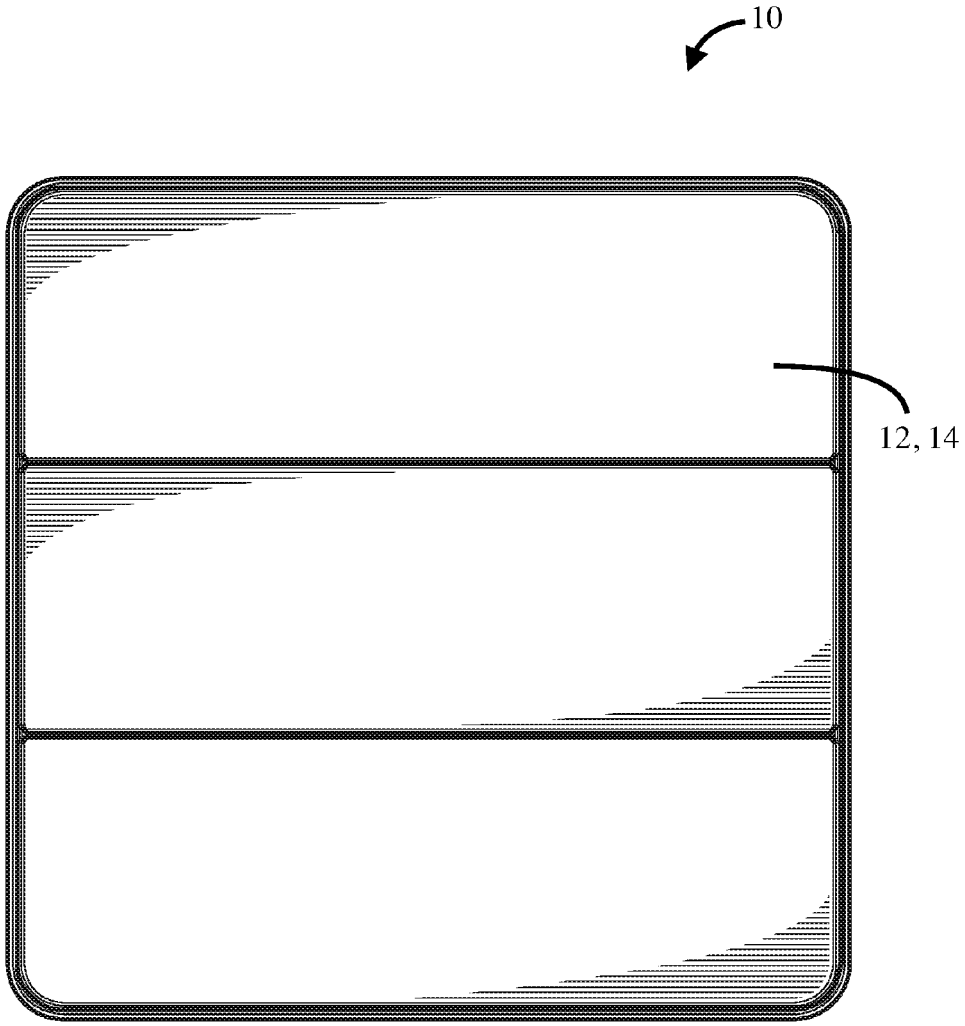
FIG. 3 is a top plan view of the collapsible table in the use position in accordance with one embodiment of the present disclosure.

Referring to FIGS. 1-16, a collapsible table 10 in accordance with the preferred embodiment of the present disclosure includes a tabletop 12 having a planar top surface 14, a bottom surface 16 opposite the top surface 14, a first end 18, a second end 20 opposite the first end 18, a first side 22, and a second side 24 opposite the first side 22. The tabletop 12 is preferably substantially square shaped as shown, but may also be rectangular, oval, circular, or irregular shaped within the spirit of the present disclosure. The tabletop 12 is preferably formed from blow-molded plastic.

As shown best in FIGS. 2, 4, 10, and 12, the collapsible table 10 further includes a first pair of collapsible legs 26 having a first leg 25 and a second leg 27 secured to each other adjacent their top ends by a first support bar 28. In order to move the first pair of collapsible legs 26 between a use position (as shown in FIGS. 1-8) and a storage position (as shown in FIGS. 9-16), the first support bar 28 is pivotally connected to the bottom surface 16 of the tabletop 12 preferably adjacent to the first end 18 by a hinge assembly. The particular type of hinge assembly is not critical as long as it provides means for the first support bar 28 and associated first pair of collapsible legs 26 to be rotated between use and storage positions as explained below. In certain embodiments and referring to FIGS. 2, 4, 10, and 12, the hinge assembly includes hinge pins (not shown) extending from opposite ends of the the first support bar 28 and rotatably connected to frame members 30 disposed adjacent to the first side 22 and second side 24 of the bottom surface 16 of tabletop 12. Alternatively, first support bar 28 is secured within one or more cylindrical receivers that allow for rotation of the first support bar 28 in relation to the bottom surface 16 of the tabletop 12. In preferred embodiments, first support bar 28 is substantially non-removably secured to its hinge assembly. In other words, while the first pair of collapsible legs 26 can be rotated with respect to the bottom surface 16 of the tabletop 12, it is preferred that the first pair of collapsible legs 26 can be easily disconnected from the bottom surface 16.

Figure 4:
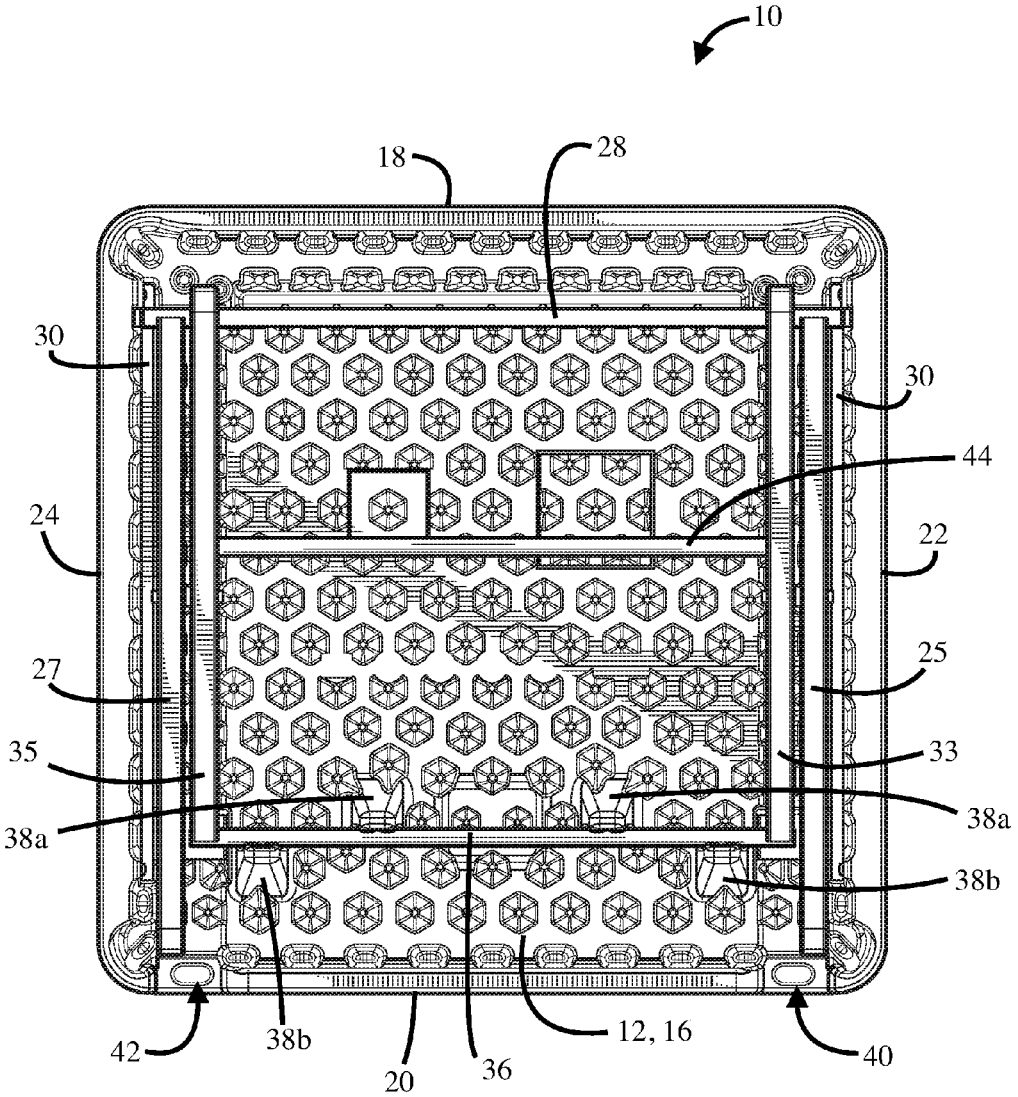
FIG. 4 is a bottom plan view of the collapsible table in the use position in accordance with one embodiment of the present disclosure.
Figure 5:
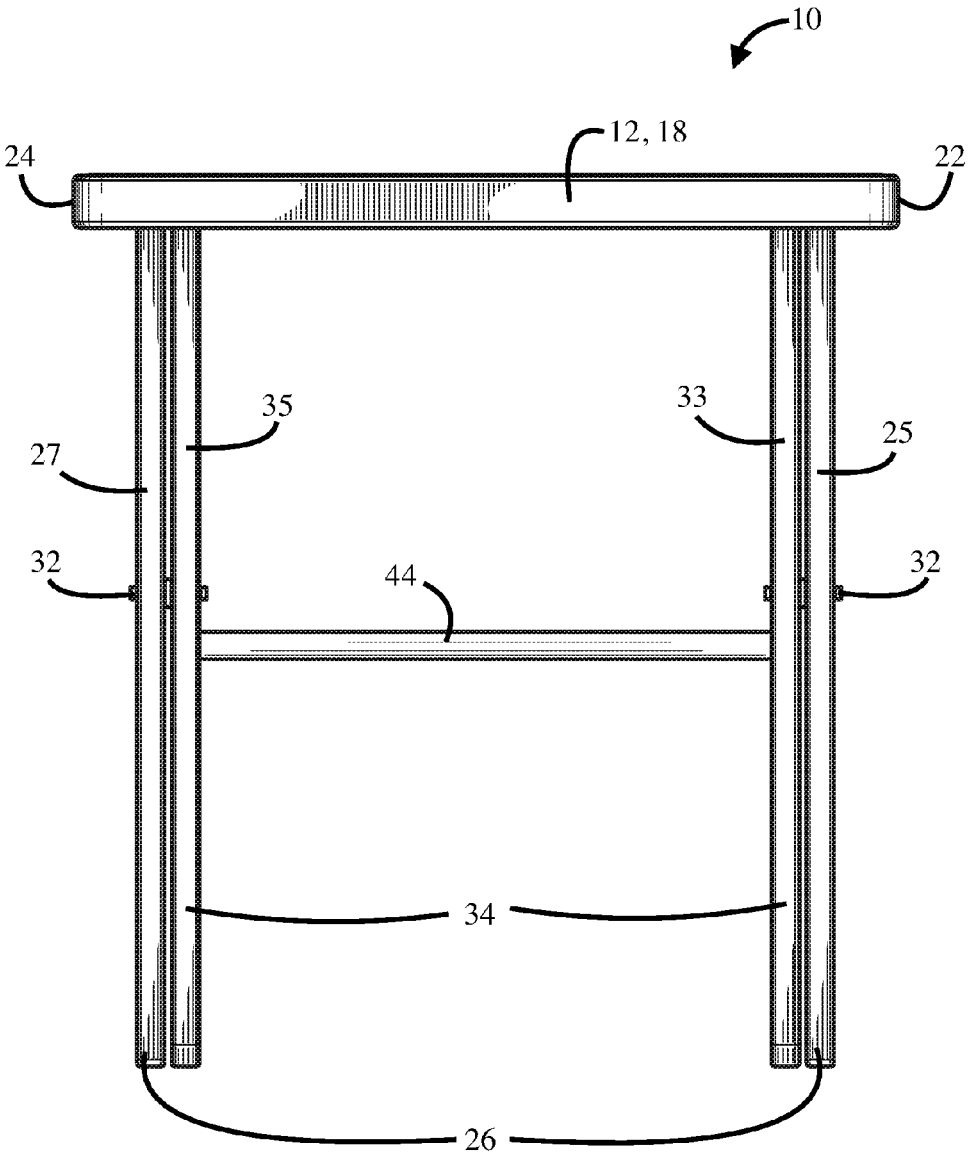
FIG. 5 is a front elevation view of the collapsible table in the use position in accordance with one embodiment of the present disclosure.
Figure 6:
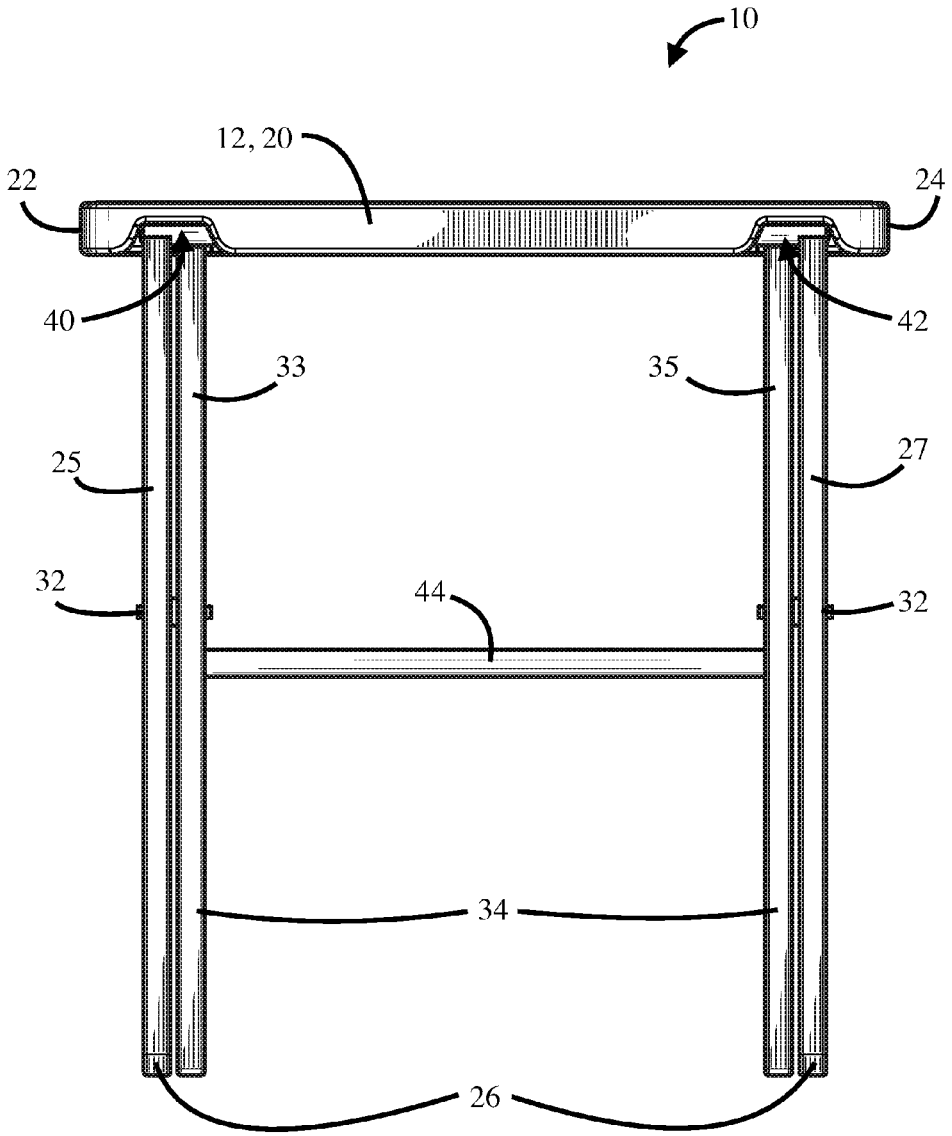
FIG. 6 is a rear elevation view of the collapsible table in the use position in accordance with one embodiment of the present disclosure.

A second pair of collapsible legs 34 having a third leg 33 and a fourth leg 35 are secured to each other adjacent their top ends by a second support bar 36. While the first pair of collapsible legs 26 are preferably non-removably secured adjacent the first end 18 of tabletop 12 as explained above, the second pair of collapsible legs 34 are preferably operable to be removably secured to the bottom surface 16 of tabletop 12 adjacent to the second end 20. In order to removably secure the second pair of collapsible legs 34, the bottom surface 16 includes one or more appropriately positioned and configured brackets 38 that together are operable to securely receive and release the second support bar 36 as desired. It is noted that brackets 38 are configured so as to not permit any substantial rotation of the second support bar 36 when the bar 36 is received within the brackets 38. In preferred embodiments, the brackets 38 are molded into the bottom surface 16 of the tabletop 12 and each include cylindrical receiving surfaces dimensioned and configured to receive a portion of the cylindrical second support bar 36 in the use position. Referring to FIG. 4, in preferred embodiments, the bottom surface 16 includes a first set of brackets 38*a* positioned to receive one side of the second support bar 36 in the use position and a second set of brackets 38*b* positioned to receive the other side of the second support bar 36. Together, brackets 38*a* and 38*b* provide a "snap-fit" when inserting the second support bar 36 into the brackets to secure the second pair of collapsible legs 34 to the bottom surface 16 of the tabletop 12. In alternate embodiments, each of the brackets 38 are horizontally aligned and each include cylindrical tabs dimensioned and configured so that a cylindrical support bar 36 is operable to "snap-fit" into the cylindrical tabs of each of the brackets 38.

Figure 7:
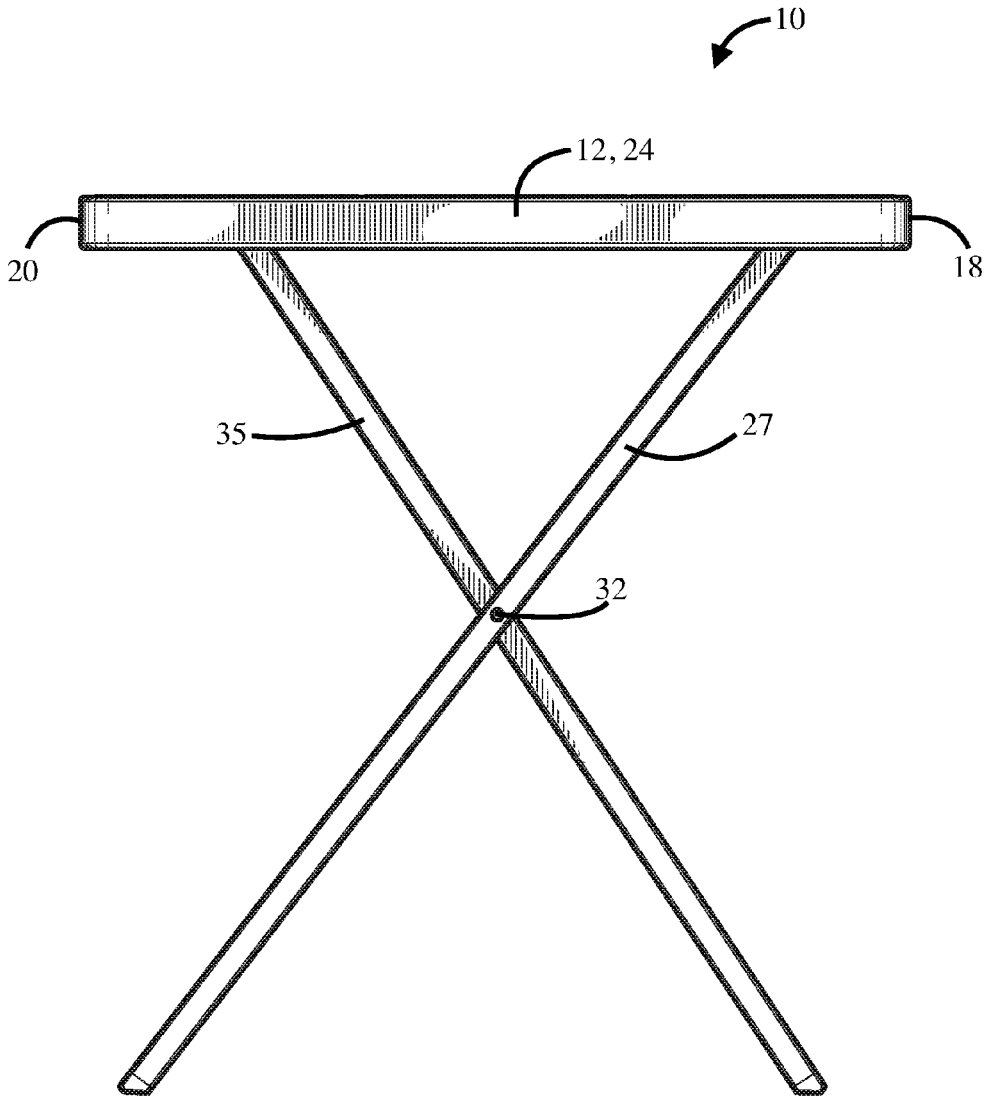
FIG. 7 is a left side elevation view of the collapsible table in the use position in accordance with one embodiment of the present disclosure.
Figure 8:
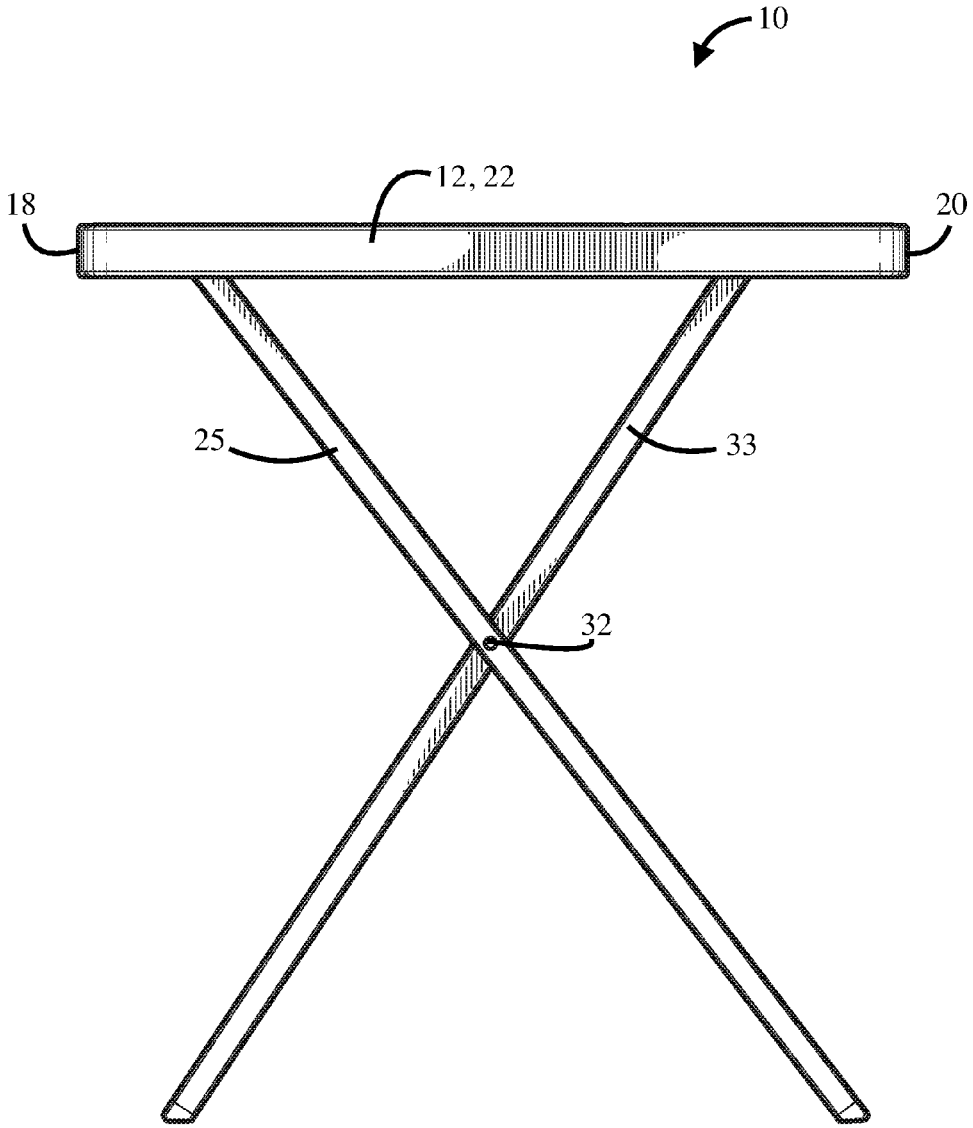
FIG. 8 is a right side elevation view of the collapsible table in the use position in accordance with one embodiment of the present disclosure.
Figure 9:
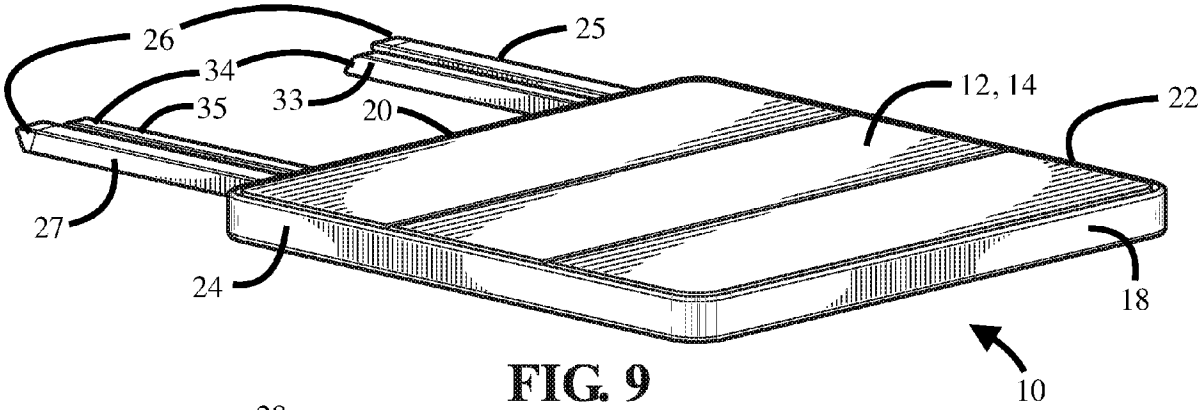
FIG. 9 is a top perspective view of the collapsible table in a storage position in accordance with one embodiment of the present disclosure.
Figure 10:
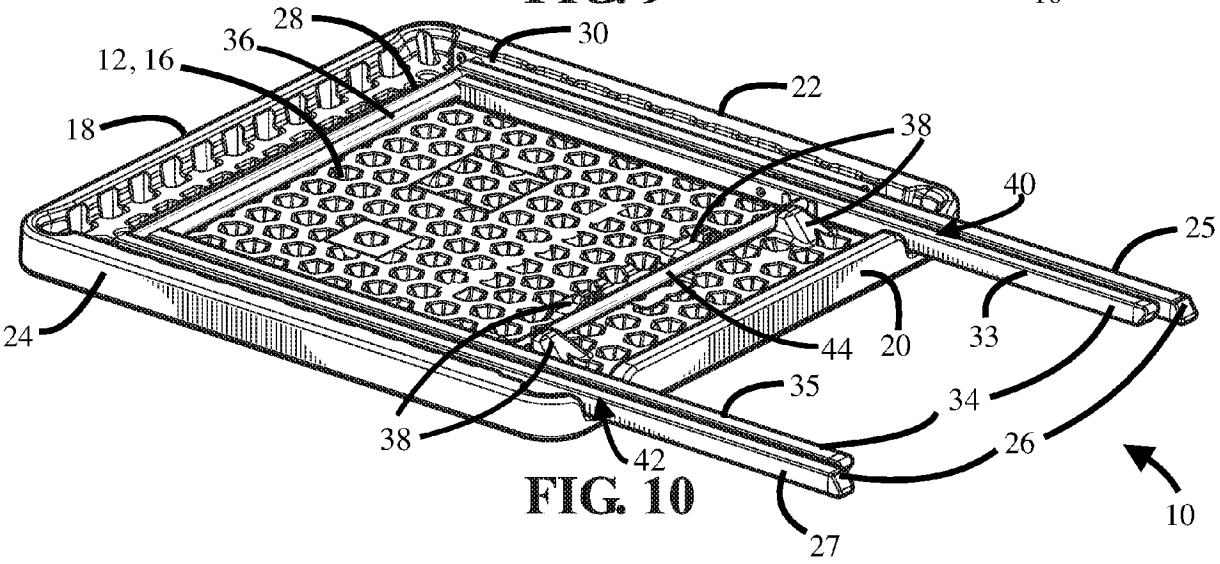
FIG. 10 is a bottom perspective view of the collapsible table in the storage position in accordance with one embodiment of the present disclosure.
Figure 11:
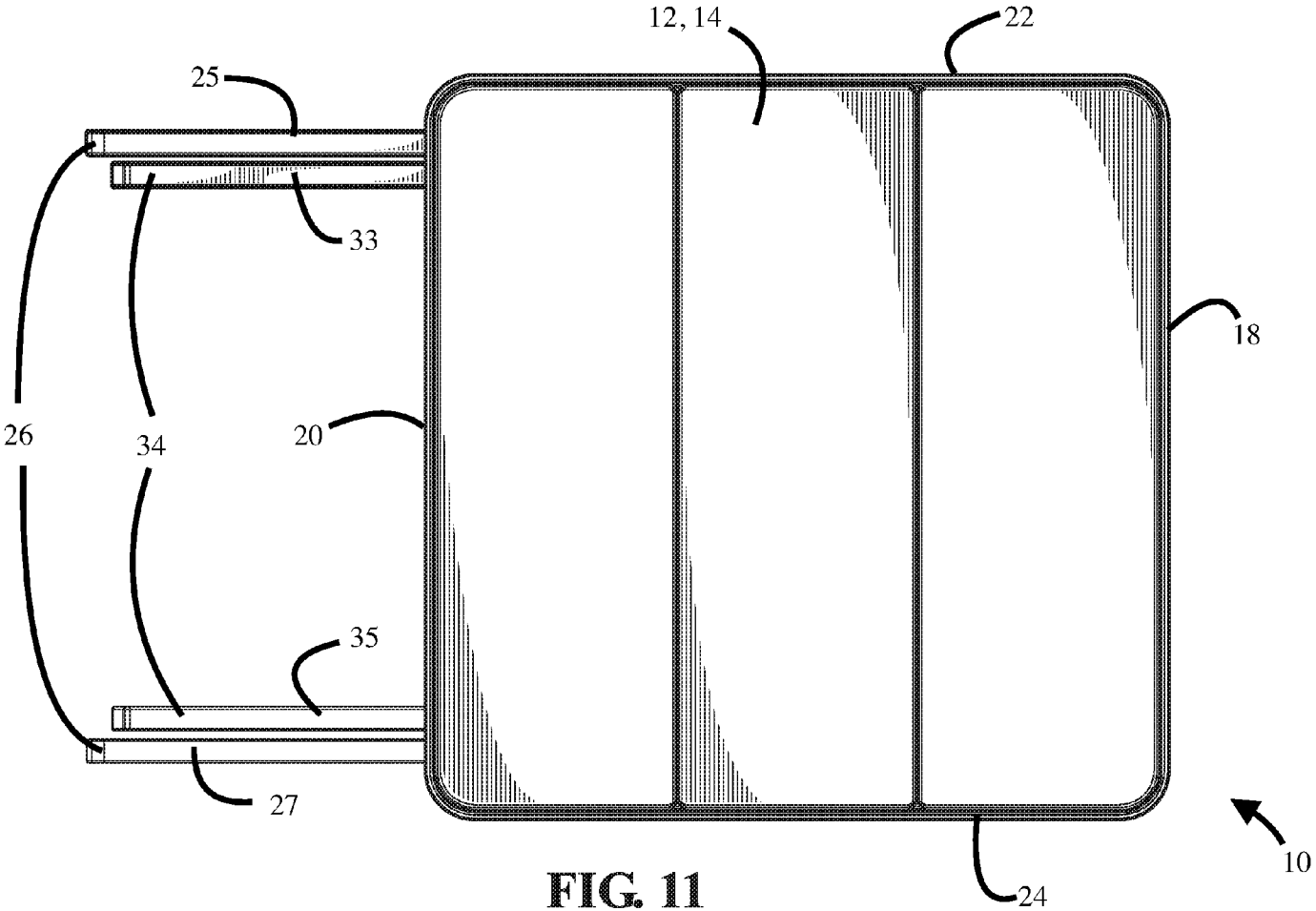
FIG. 11 is a top elevation view of the collapsible table in the storage position in accordance with one embodiment of the present disclosure.
Figure 12:
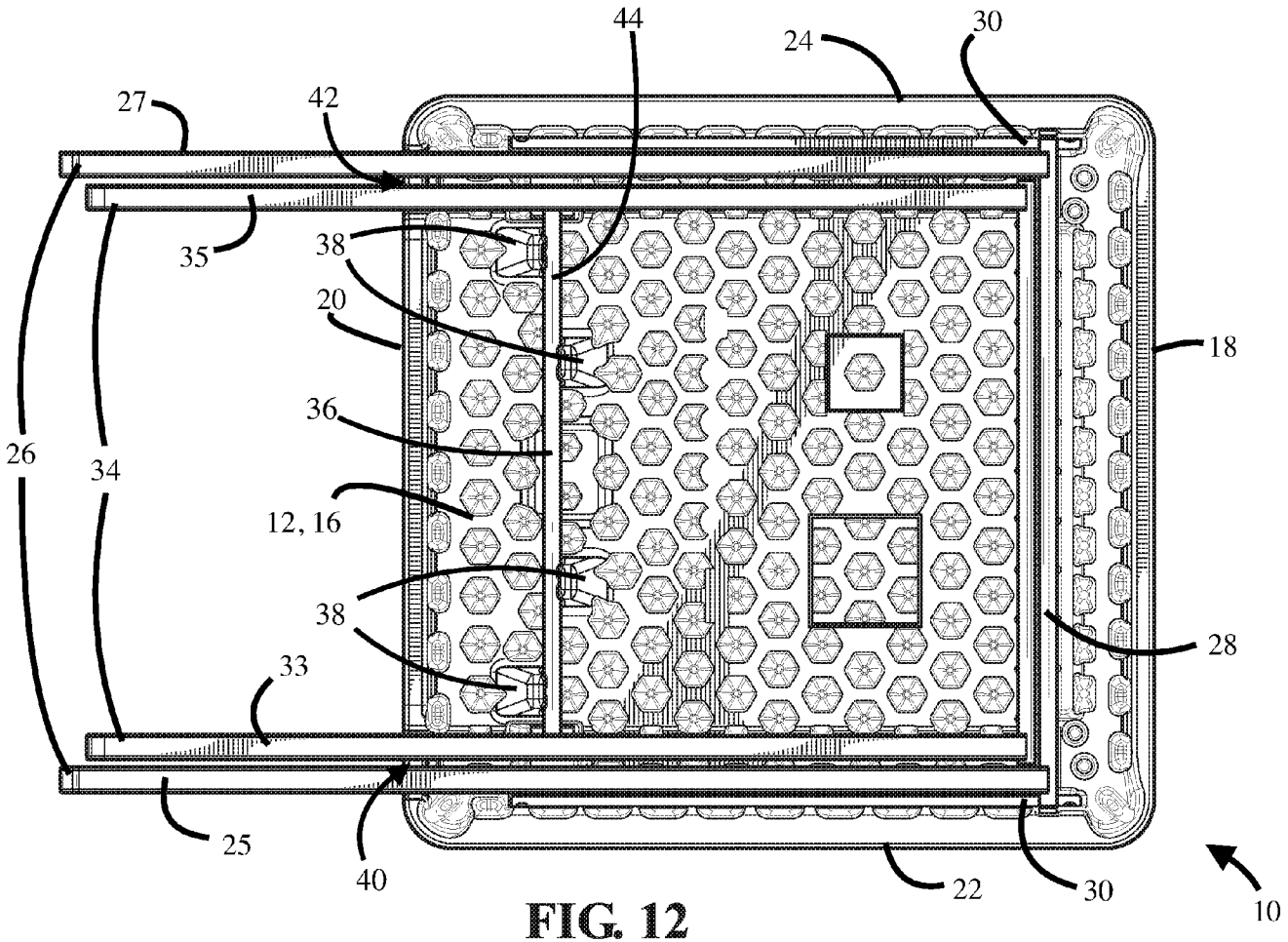
FIG. 12 is a bottom elevation view of the collapsible table in the storage position in accordance with one embodiment of the present disclosure.
Figure 13:
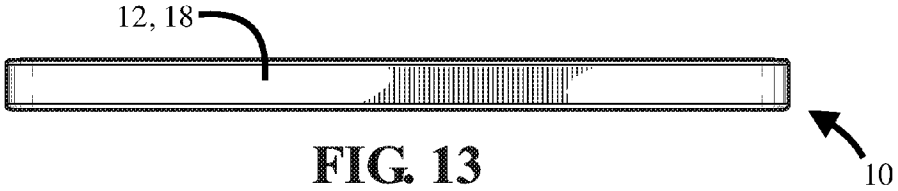
FIG. 13 is a front elevation view of the collapsible table in the storage position in accordance with one embodiment of the present disclosure.
Figure 14:
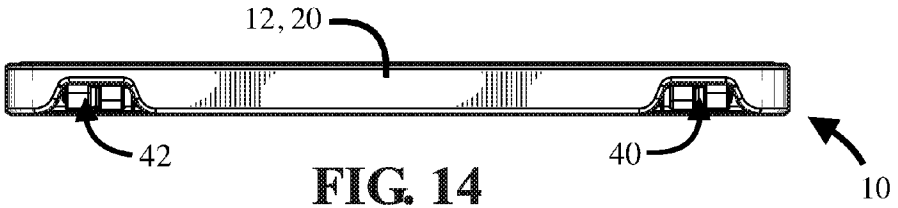
FIG. 14 is a rear elevation view of the collapsible table in the storage position in accordance with one embodiment of the present disclosure.
Figure 15:
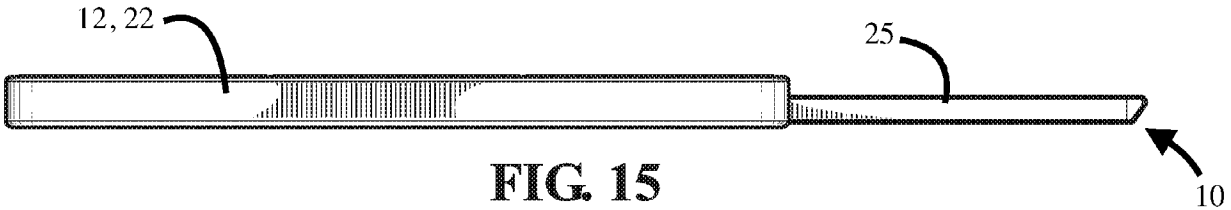
FIG. 15 is a left side elevation view of the collapsible table in the storage position in accordance with one embodiment of the present disclosure.
Figure 16:
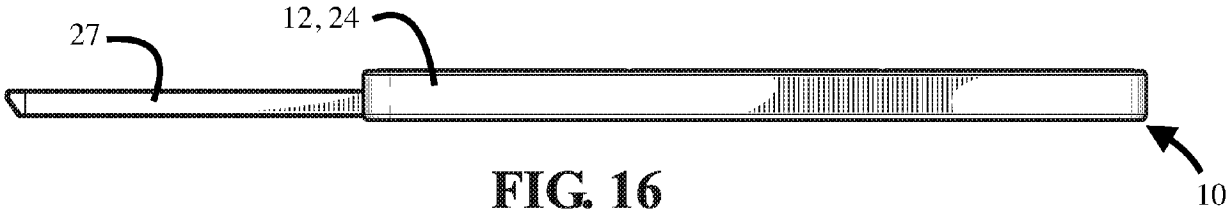
FIG. 16 is a right side elevation view of the collapsible table in the storage position in accordance with one embodiment of the present disclosure.

Referring to FIGS. 1, 7, and 8, the first pair of collapsible legs 26 are preferably pivotally cross-connected with the second pair of collapsible legs 34 using pivot members 32 that pivotally connect the first leg 25 to the third leg 33 and the second leg 27 to the fourth leg 35. Thus, when in the use position where the second support bar 36 is received by the one or more brackets 38 and no substantial rotation of the second support bar 36 is permitted, the first pair of collapsible legs 26 are also in a fixed position to provide a sturdily supported tabletop 12. However, when the second support bar 36 is removed from the one or more brackets 38, the first pair of collapsible legs 26 and the second pair of collapsible legs 34 are operable to pivot relative to each other to move from the use position to a storage position. In the storage position, the legs are preferably all positioned substantially perpendicular to the ends 18 and 20 of the tabletop 12 (as best shown in FIGS. 9-10), and the second support bar 36 is received within the bottom surface 16 of the tabletop 12 adjacent to the first end 18 and the first support bar 28 (as best shown in FIG. 10). It is noted that, to permit the pivoting movement described above, the second support bar 36 has a slightly smaller length than the first support bar 28. As a result, the second pair of collapsible legs 34 fit between and are able to move within the space of the first pair of collapsible legs 26.

In preferred embodiments where the legs of table 10 are longer than the distance between the first end 20 and second end 22 of tabletop 12 as commonly occurs with respect to tables having a smaller surface area such as bistro tables, the second end 20 of tabletop 12 includes a first receiving channel 40 and a second receiving channel 42. The first receiving channel 40 is positioned and configured for receiving a portion of the first leg 25 and the third leg 33 in their respective collapsed positions. The second receiving channel 42 is positioned and configured for receiving a top end portion of the second leg 27 and fourth leg 35 in their respective collapsed positions. For purposes of the present disclosure, the top end portions of the legs 25, 27, 33, and 35 are the portions of the legs that are disposed beneath the bottom surface 16 of the tabletop 12 in the storage position. Together, the first and second receiving channels 40 and 42 permit a more compact storage position by allowing the top end portions of the legs 25, 27, 33, and 35 to be received directly beneath the bottom surface 16 within the first end 18 and the second end 20 of the tabletop 12 with the bottom end portions of the legs extending out from the receiving channels 40 and 42.

To provide further support to the collapsible table 10, a third support bar 44 is preferably provided that, like the second support bar 36, secures the second leg 33 to the fourth leg 35. As shown best by comparing FIGS. 2 and 10, the third support bar 44 is preferably positioned between the second leg 33 and fourth leg 35 such that it can be removably secured in the storage position to the same brackets 38 used to removably secure the second support bar 36 in the use position. In other words, the third support bar 44 connects the second pair of collapsible legs 34 to the bottom surface 16 of the tabletop 12 in the storage position via brackets 38 while the second support bar 36 connects the second pair of collapsible legs 34 to the bottom surface 16 of the tabletop 12 in the use position via one or more of the same brackets 38. Removably securing the third support bar 44 to the bottom surface 16 of the tabletop 12 provides a sturdier storage position in which the legs will only move when desired. Further, by removably securing the third support bar 44 in the storage position to the same brackets 38 used to secure the second support bar 36 in the use position, a more efficiently molded tabletop 12 is provided with fewer molded parts.

The collapsible table 10 described above is believed to be best utilized with respect to tabletops and related surfaces having a smaller sized surface area such bistro tables, television trays, folding chairs, stools, etc. where the legs have a greater length than the distance between opposing ends or sides of the surface supported by the legs. Thus, while the present disclosure is described herein with respect to collapsible table 10, it should be understood that the disclosure could also be utilized with respect to other surfaces that are supported by collapsible legs such as a chair or stool.

According to an alternative embodiment, the table is substantially as described above except that the first leg 25 and second leg 27 are operable to be collapsed independently of each other as known in the art. Thus, according to this embodiment, first support bar 28 connecting the first leg 25 to the second leg 27 is not required, and the first pair of collapsible legs 26 are not pivotally cross-connected to the second pair of collapsible legs 34.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A collapsible table comprising:

a tabletop comprising a top surface, a bottom surface opposite the top surface, a first end, and a second end opposite the first end;

a first pair of collapsible legs comprising a first leg having a top end portion, a second leg having a top end portion, and a first support bar for connecting the first leg to the second leg adjacent their top end portions, the first support bar pivotally connected to the bottom surface of the tabletop;

a second pair of collapsible legs comprising a third leg having a top end portion, a fourth leg having a top end portion, a second support bar for connecting the third leg to the fourth leg adjacent their top end portions, and a third support bar spaced apart from the second support bar for connecting the third leg to the fourth leg, the first and second pair of collapsible legs operable to move between a use position wherein the legs extend from the bottom surface to support the tabletop to a storage position wherein at least the top end portions of each of the legs are disposed adjacent to the bottom surface of the tabletop; and one or more brackets disposed adjacent the bottom surface of the tabletop, the one or more brackets positioned and configured to removably secure the second support bar to the bottom surface of the tabletop in the use position and removably secure the third support bar to the bottom surface of the tabletop in the storage position, wherein each of the legs of the first and second pairs of collapsible legs is of a length that is greater than a distance between the first and second ends of the tabletop.

2. The collapsible table of claim 1 wherein each of the legs of the first and second pair of collapsible legs is operable to collapse to positions which are substantially perpendicular to the first and second ends of the tabletop.

3. The collapsible table of claim 1 wherein the second end of the tabletop includes a first receiving channel positioned and configured to receive the first leg and the third leg below their top end portions and a second receiving channel positioned and configured to receive the second leg and the fourth leg below their top end portions in the storage position.

4. The collapsible table of claim 1 wherein the tabletop is formed from blow-molded plastic.

5. The collapsible table of claim 4 wherein the one or more brackets are integrally formed from the blow-molded plastic of the tabletop.

6. The collapsible table of claim 1 wherein the one or more brackets include a first set of brackets positioned and configured to receive a first portion of the second or third support bar and a second set of brackets positioned and configured to receive a second portion of the second or third support bar for removably securing the second support bar in the use position and the third support bar in the storage position.

7. The collapsible table of claim 1 wherein the one or more brackets are configured to prevent any substantial rotation of the second and third support bars in the respective use and storage positions.

8. The collapsible table of claim 1 wherein the second pair of collapsible legs is pivotally connected to the first pair of collapsible legs.

9. The collapsible table of claim 1 wherein the first support bar is substantially non-removably secured to the bottom surface of the tabletop.

10. A collapsible supporting structure comprising:

a supporting structure comprising a top surface, a bottom surface opposite the top surface, a first end, and a second end opposite the first end;

a first pair of collapsible legs comprising a first leg having a top end portion and a second leg having a top end portion, each of the top end portions of the first and second legs secured to the bottom surface of the supporting structure adjacent the first end;

a second pair of collapsible legs comprising a third leg having a top end portion, a fourth leg having a top end portion, a first support bar for connecting the third leg to the fourth leg adjacent their top end portions, and a second support bar spaced apart from the first support bar for connecting the third leg to the fourth leg, the first and second pair of collapsible legs operable to move between a use position wherein the legs extend from the bottom surface to support the supporting structure to a storage position wherein at least the top end portions of each of the legs are disposed adjacent to the bottom surface of the supporting structure; and one or more brackets disposed adjacent the bottom surface of the supporting structure, the one or more brackets positioned and configured to removably secure the first support bar to the bottom surface of the supporting structure in the use position and removably secure the second support bar to the bottom surface of the supporting structure in the storage position, wherein each of the legs of the first and second pairs of collapsible legs is of a length that is greater than a distance between the first and second ends of the supporting structure.

11. The collapsible supporting structure of claim 10 wherein each of the legs of the first and second pair of collapsible legs are operable to collapse to positions which are substantially perpendicular to the first and second ends of the supporting structure.

12. The collapsible supporting structure of claim 10 wherein the second end of the supporting structure includes a first receiving channel positioned and configured to receive the first leg and the third leg below their top end portions and a second receiving channel positioned and configured to receive the second leg and the fourth leg below their top end portions in the storage position.

13. The collapsible supporting structure of claim 10 wherein the supporting structure is formed from blow-molded plastic.

14. The collapsible supporting structure of claim 13 wherein the one or more brackets are integrally formed from the blow-molded plastic of the supporting structure.

15. The collapsible supporting structure of claim 10 wherein the one or more brackets include a first set of brackets positioned and configured to receive a first portion of the first or second support bar and a second set of brackets positioned and configured to receive a second portion of the first or second support bar for removably securing the first support bar in the use position and the second support bar in the storage position.

16. The collapsible supporting structure of claim 10 wherein the one or more brackets are configured to prevent any substantial rotation of the first and second support bars in the respective use and storage positions.

17. The collapsible supporting structure of claim 10 wherein the supporting structure is one of a table, a chair, a bench, a stool, and a step-ladder.

* * * * *